United States Patent [19]

Hibino et al.

[11] Patent Number: 4,765,305

[45] Date of Patent: Aug. 23, 1988

[54] CONTROL METHOD OF CONTROLLING AN AIR/FUEL RATIO CONTROL SYSTEM IN AN INTERNAL COMBUSTION ENGINE

[75] Inventors: Yoshitaka Hibino; Takeshi Fukuzawa; Atsushi Totsune, all of Wako, Japan

[73] Assignee: Honda Giken Kogyo Kabushiki Kaisha, Tokyo, Japan

[21] Appl. No.: 2,346

[22] Filed: Jan. 12, 1987

[30] Foreign Application Priority Data

Jan. 13, 1986 [JP] Japan ..... 61-5498

[51] Int. Cl.[4] ..... F02M 23/06

[52] U.S. Cl. ..... 123/589; 123/440

[58] Field of Search ..... 123/589, 440, 489, 585

[56] References Cited

U.S. PATENT DOCUMENTS

| | | | |
|---|---|---|---|
| 4,359,029 | 11/1982 | Furuhashi et al. | 123/440 |
| 4,393,842 | 7/1983 | Otsuka et al. | 123/440 |
| 4,557,242 | 12/1985 | Hasegawal | 123/589 |
| 4,649,882 | 3/1987 | Kawanabe et al. | 123/589 |

*Primary Examiner*—Willis R. Wolfe
*Assistant Examiner*—M. Macy
*Attorney, Agent, or Firm*—Pollock, VandeSande and Priddy

[57] ABSTRACT

In a method for determining a control parameter of an air/fuel ratio control system of an internal combustion engine by means of an oxygen concentration sensor disposed in an exhaust system of the engine, the control parameter of the air/fuel ratio is determined independently of the output signal of the oxygen concentration sensor when a light load operation of the engine continued for more than a predetermined time period is detected.

4 Claims, 7 Drawing Sheets

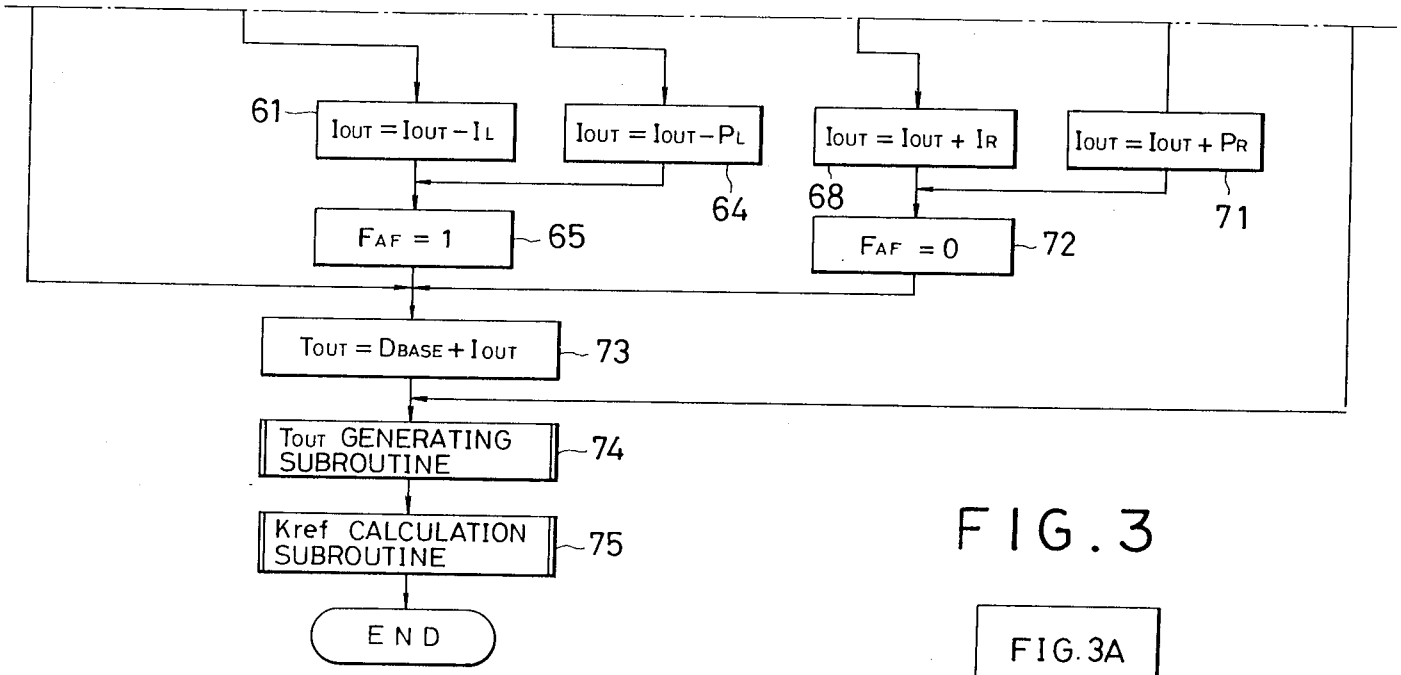
FIG. 3B
FIG. 3
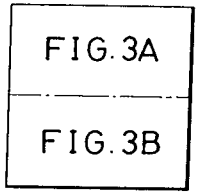

CONTROL METHOD OF CONTROLLING AN AIR/FUEL RATIO CONTROL SYSTEM IN AN INTERNAL COMBUSTION ENGINE

BACKGROUND OF THE INVENTION

1. Field of the Invention

The present invention relates to a method of controlling the air/fuel ratio control system in an internal combustion engine.

2. Description Of Background Information

Various air/fuel ratio control systems for internal combustion engines are known from, for example, Japanese Patent Publication No. 55-3533, which systems regulate the air/fuel ratio of the mixture to be supplied to the engine toward a target air/fuel ratio by selecting values of control parameters for the air/fuel ratio control systems in response to the output signal of an oxygen concentration sensor disposed at the exhaust system of the engine thereby to regulate the volume of air or fuel to be supplied to the engine for the purification of the exhaust gases, the improvement of the fuel economy, etc. The air/fuel ratio control parameter may be, for example, a valve-open period in an intake side secondary air supply system, and fuel injection period in a fuel injection system.

It is, in this instance, to be noted that the oxygen concentration sensor used in the air/fuel ratio control systems does not become sufficiently active to produce desired output signals until the temperature of the sensor per se rises up to a certain level. It is therefore difficult to obtain accurate operation of the air/fuel control system during low temperature operation of the oxygen concentration sensor. It is, on the other hand, natural that the temperature of the oxygen concentration sensor is dependent upon the temperature of the exhaust gases since the oxygen concentration sensor is disposed within the exhaust gas flow. The temperature of the oxygen concentration sensor lowers during a low load operational condition, such as an idle condition, of the engine rather than high or medium load operational conditions since the temperature of the exhaust gases lowers during a light load operational condition. There is therefore a possibility that the oxygen concentration sensor will become inactive due to reduction of the temperature thereof below a certain level at a light load operational condition of the engine. During such an inactive condition of the oxygen concentration sensor, the sensor may produce an output signal representing a lean condition even though the actual air/fuel ratio is richer than the target air/fuel ratio, whereby the air/fuel ratio is regulated toward the rich side to cause an increase of unburned contents such as carbon monoxide and hydrocarbons in the exhaust gases.

OBJECTS AND SUMMARY OF THE INVENTION

Accordingly, an object of the subject invention is to provide an improved method of controlling the air/fuel ratio of the mixture to be supplied to an internal combustion engine in response to an oxygen concentration signal produced by an oxygen concentration sensor provided at an exhaust system of the engine, while avoiding incorrect operation during an inactive state of the oxygen concentration sensor.

According to the present invention, a control method of an air/fuel ratio control system in an internal combustion engine selects, as an air/fuel ratio control value, a value by which the air/fuel ratio of the mixture can be controlled around a target air/fuel ratio irrespectively of the output signal of an oxygen concentration sensor during a time period in which a light load operation of the internal combustion engine is detected after a continuation of the light load operation for more than a predetermined time period.

BRIEF DESCRIPTION OF THE DRAWINGS

FIGS. 3A, and 3B, when combined, are a flowchart showing the manner of operation of a CPU 29 in the control circuit 20 according to the control method of the present invention;

FIG. 3 is a diagram showing the juxtaposition of FIGS. 3A and 3B;

DETAILED DESCRIPTION OF THE PREFERRED EMBODIMENT

Referring to the accompanying drawings, the embodiment of the control method of the present invention will be explained hereinafter.

Figure 1:
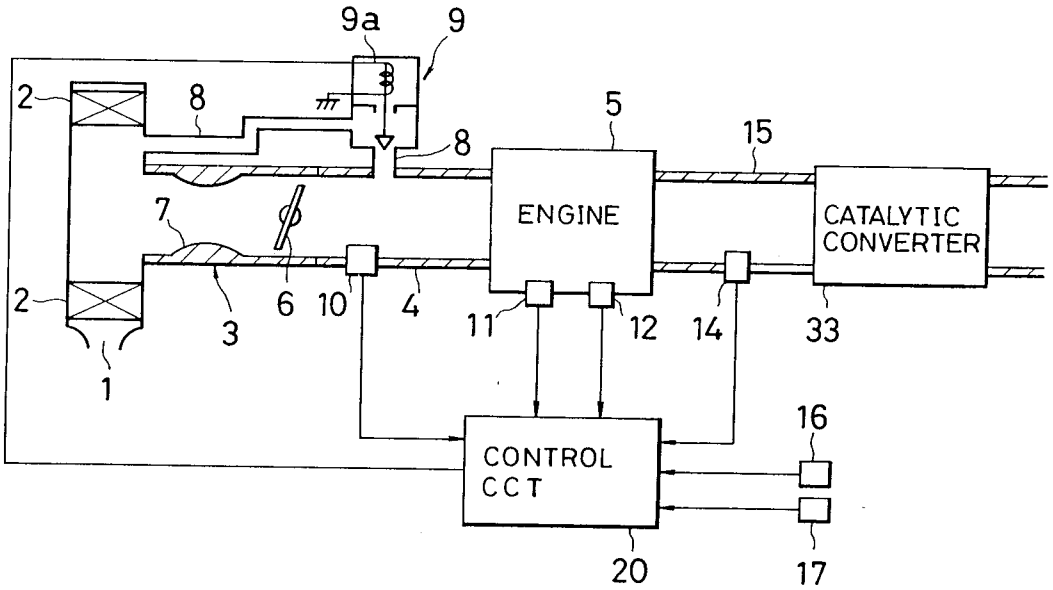
FIG. 1 is a schematic diagram showing a general construction of the air/fuel ratio control system in which the control method according to the invention is applied.

FIG. 1 illustrates a general construction of an air intake side secondary air supply system of an internal combustion engine in which the control method for controlling the air/fuel ratio according to the present invention is applied. As shown, intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6.

The inside of the air cleaner 2, near an air outlet port, communicates with the intake manifold 4 via an air intake side secondary air supply passage 8. The air intake side secondary air supply passage 8 is provided with a linear type solenoid valve 9. The opening degree of the solenoid valve 9 is varied according to the magnitude of a drive current supplied to a solenoid 9a thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and an oxygen concentration sensor 14 which is provided in an exhaust manifold 15 of the engine for generating an output signal whose level varies in proportion to the oxygen concentration in the exhaust gas. Further, a catalytic converter 33 for accelerating the reduction of the unburned components in the exhaust gas is provided in the exhaust manifold 15 at a location on the downstream side of the oxygen concentration sensor 14. The linear type solenoid valve 9, the absolute pressure sensor 10, the crank angle sensor 11, the engine cooling water temperature sensor 12, and the oxygen concentration sensor 14 are electrically connected to a control circuit 20. Further, a vehicle speed sensor 16 which produces an output signal whose level is proportional to the speed of the vehicle and an atmospheric pressure sensor 17 are electrically connected to the control circuit 20.

Figure 2:
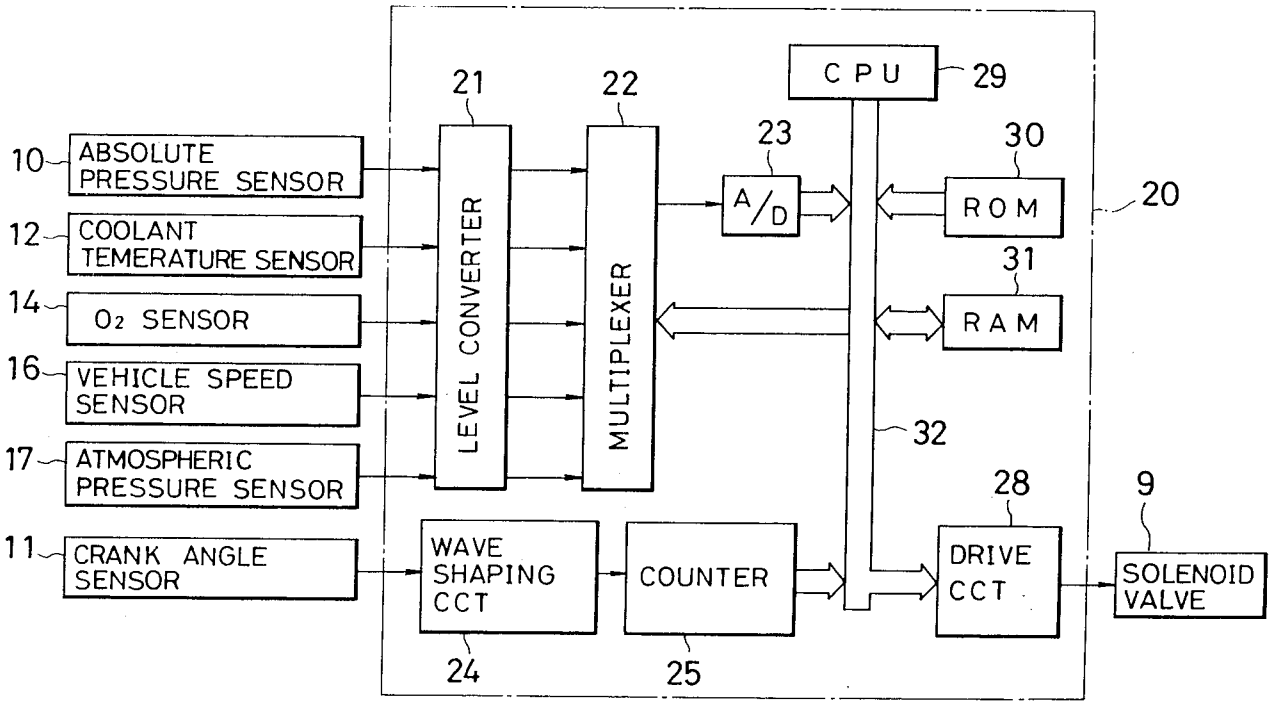
FIG. 2 is a block diagram showing the construction of the control circuit 20 of the system of FIG. 1.

FIG. 2 shows the construction of the control circuit 20. As shown, the control circuit 20 includes a level converting circuit 21 which performs level conversion of the output signals of the absolute pressure sensor 10, the engine cooling water temperature sensor 12, the oxygen concentration sensor 14, the vehicle speed sensor 16, and the atmospheric pressure sensor 17. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which performs a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the solenoid valve 9 in an opening direction, a CPU (central processing unit) 29 which performs digital operations according to various programs, a ROM 33 in which various operating programs and data are previously stored, and a RAM 31. The solenoid 9a of the solenoid valve 9 is connected in series with a drive transistor and a current detection resistor, both not shown, of the drive circuit 28. A power voltage is applied across the terminals of the above mentioned series circuit. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one cycle of a predetermined period $T_1$ (5m sec, for instance). In response to this internal interruption signal, the CPU 29 calculates an output value $T_{OUT}$ indicative of the magnitude of the current to the solenoid 9a of the solenoid valve 9, in the form of data. The calculated output value $T_{OUT}$ is in turn supplied to the drive circuit 28 as the air/fuel ratio control parameter. The drive circuit 28 performs a closed loop control of the magnitude of the current flowing through the solenoid 9a so that it is controlled to a value corresponding to the output value $T_{OUT}$.

Referring to the flowcharts of FIGS. 3A and 3B, 4 and 5, the operation of the air intake side secondary air supply system which performs the control method according to the present invention will be explained hereinafter.

Figure 3A:
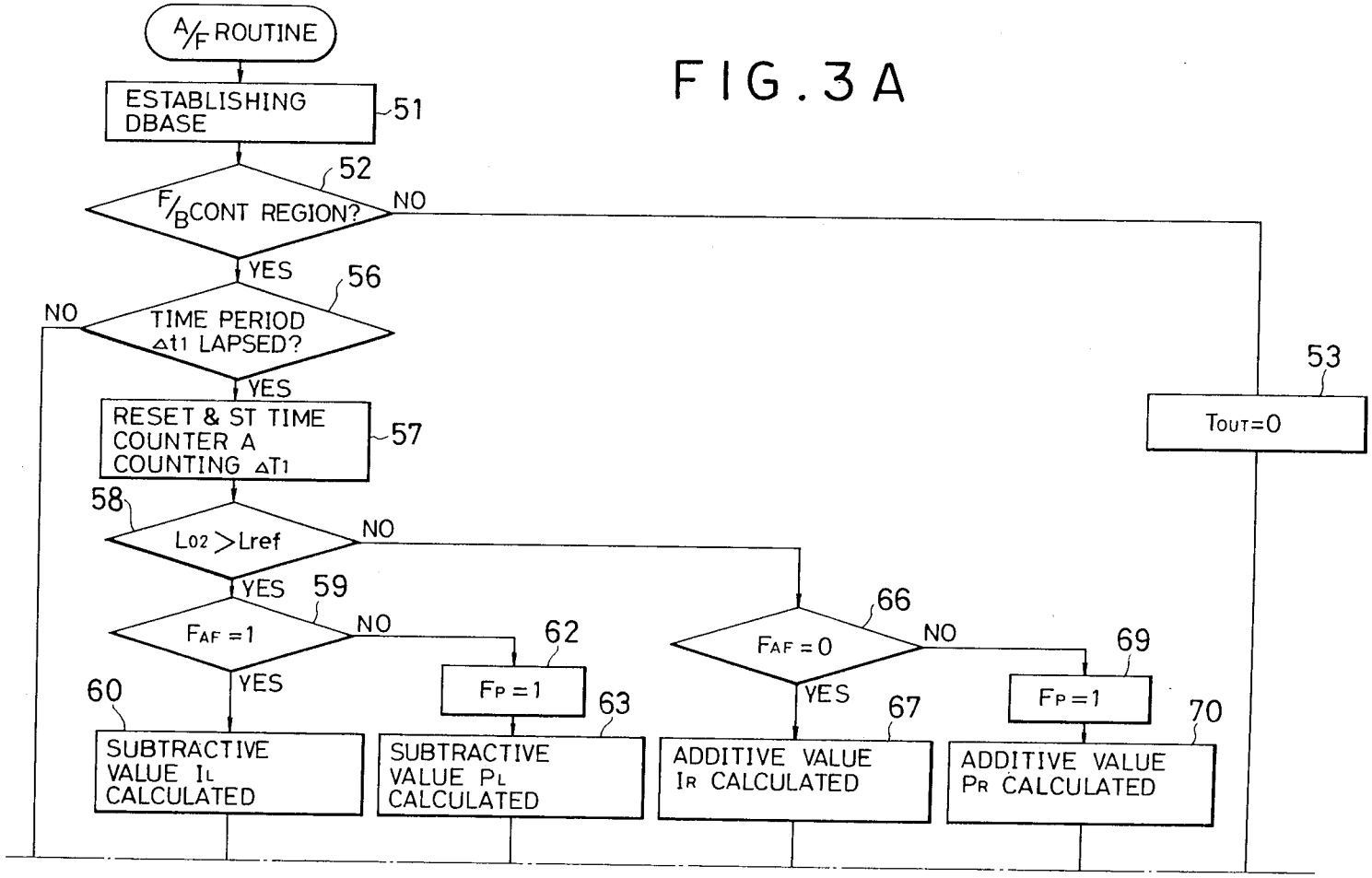
Figure 6:
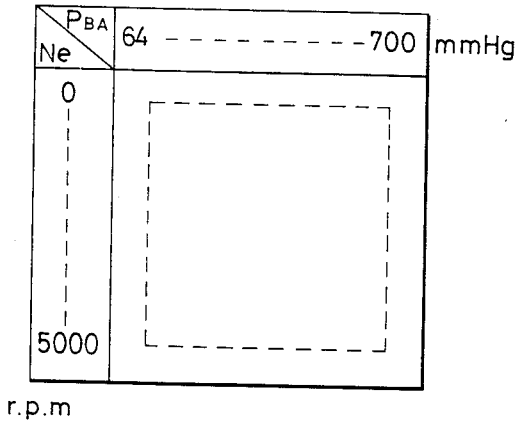
FIG. 6 is a diagram showing a $D_{BASE}$ data map which is previously stored in a ROM 30 of the control circuit 20.

As shown in FIG. 3A, in the CPU 29, a base value $D_{BASE}$ indicative of the base value of the current to the solenoid valve 9 is set every time the internal interruption signal is generated, at a step 51. Various values of the base value $D_{BASE}$ which are determined according to the absolute pressure within the intake manifold $P_{BA}$ and the engine rotational speed $N_e$ are previously stored in the ROM 30 in the form of a $D_{BASE}$ data map as shown in FIG. 6, and the CPU 29 at first reads present values of the absolute pressure $P_{BA}$ and the engine rotational speed $N_e$ and in turn searches a value of the base value $D_{BASE}$ corresponding to the read values from the $D_{BASE}$ date map in the ROM 30. After the setting of the base value $D_{BASE}$, whether or not the operating state of the vehicle satisfies a condition for the feedback (F/B) control is detected at a step 52. This detection is performed on the basis of various parameters, i.e., absolute pressure $P_{BA}$ within the intake manifold, engine cooling water temperature $T_W$, vehicle speed V, and engine rotational speed $N_e$. For instance, when the vehicle speed is low, or when the engine cooling water temperature is low, it is determined that the condition for the feedback control is not satisfied. If it is determined that the condition for the feedback control is not satisfied, the output value $T_{OUT}$ is made equal to "0" at a step 53 so that the feedback control is stopped.

On the other hand, if it is determined that the condition for the feedback control is satisfied, whether or not a count period of a time counter A incorporated in the CPU 29 (not shown) has reached a predetermined time period $\Delta t_1$ is detected at a step 56. This predetermined time period $\Delta t_1$ corresponds to a delay time from a time of the supply of the air intake side secondary air to a time in which a result of the supply of the air intake side secondary air is detected by the oxygen concentration sensor 14 as a change in the oxygen concentration of the exhaust gas. When the predetermined time period $\Delta t_1$ has lapsed after the time counter A is reset to start the counting of time, the counter is reset again, at a step 57, to start the counting of time from a predetermined initial value. In other words, a detection as to whether or not the predetermined time period $\Delta t_1$ has lapsed after the start of the counting of time from the initial value by the time counter A, i.e. the execution of the step 57, is performed at the step 56.

After the start of the counting of the predetermined time period $\Delta t_1$ by the time counter A in this way, whether or not the output signal level $LO_2$ of the oxygen concentration sensor 14 is greater than a reference value Lref which corresponds to a target air/fuel ratio is detected at a step 58. In other words, whether or not the air/fuel ratio of mixture is leaner than the target air/fuel ratio is detected at the step 58. If $LO_2 >$ Lref, indicating that the air/fuel ratio of the mixture is leaner than the target air/fuel ratio, whether or not an air/fuel ratio flag $F_{AF}$ which indicates a result of a previous cycle of detection by the step 58 is equal to "1" is detected at a step 59. If $F_{AF}=1$, it means that the air/fuel ratio was detected to be lean in a previous detection cycle. Then, a subtractive value $I_L$ is calculated at a step 60. The subtractive value $I_L$ is obtained by multiplication of a constant $K_1$, the engine rotational speed $N_e$, and the absolute pressure $P_{BA}$, ($K_1 \cdot N_e \cdot P_{BA}$), and is dependent on the amount of the intake air of the engine 5. After the calculation of the subtractive value $I_L$, a correction value $I_{OUT}$ which is previously calculated by the execution of operations of the A/F routine is read out from a memory location $a_1$ in the RAM 31. Subsequently, the subtractive value $I_L$ is subtracted from the correction value $I_{OUT}$, and the result is in turn written in the memory location $a_1$ of the RAM 31 as a new correction value $I_{OUT}$, at a step 61.

On the other hand, if $F_{AF}=0$, it means that the air/fuel ratio was detected to be rich in the previous detection cycle and the air/fuel ratio has changed from rich to lean. Therefore, a value "1" is set to a flag $F_P$ indicating the change in the direction of the air/fuel ratio control at a step 62, and a subtractive value $P_L$ is calculated at a step 63. The subtractive value $P_L$ is obtained by a multiplication between the subtractive value $I_L$ and a constant $K_3(K_3>1)$. After the calculation of the subtractive value $P_L(K_3 \cdot I_L)$, the correction value $I_{OUT}$ which is previously calculated by the execution of operations of the A/F routine is read out from the memory location $a_1$ in the RAM 31. Subsequently, the subtractive value $P_L$ is subtracted from the correction value $I_{OUT}$, and the result is in turn written in the memory location $a_1$ of the RAM 31 as a new correction value $I_{OUT}$, at a step 64.

After the calculation of the correction value $I_{OUT}$ at the step 61 or the step 64, a value "1" is set for the flag $F_{AF}$, at a step 65, for indicating that the air/fuel ratio is lean. On the other hand if $LO_2 \leqq$ Lref at the step 58, it means that the air/fuel ratio is richer than the target air/fuel ratio. Then, whether or not the air/fuel ratio flag $F_{AF}$ is "0" is detected at a step 66. IF $F_{AF}=0$, it means that the air/fuel ratio was detected to be rich in the previous detection cycle. Then, an additive value $I_R$ is calculated at a step 67. The additive value $I_R$ is calculated by a multiplication of a constant value $K_2$ ($\neq K_1$), the engine rotational speed $N_e$, and the absolute pressure $P_{BA}$, ($K_2 \cdot N_e \cdot P_{BA}$), and is dependent on the amount of the intake air of the engine 5. After the calculation of the additive value $I_R$, the correction value $I_{OUT}$ which is previously calculated by the execution of the A/F routine is read out from the memory location $a_1$ of the RAM 31, and the additive value $I_R$ is added to the read out correction value $I_{OUT}$. The result of the summation is in turn stored in the memory location $a_1$ of the RAM 31 as a new correction value $I_{OUT}$ at a step 68.

If $F_{AF}=1$ at the step 66, it means that the air/fuel ratio was detected to be lean in the previous detection cycle, and the air/fuel ratio has changed from lean to rich. Therefore, the value "1" is set for the flag $F_P$ at a step 69, and a additive value $P_R$ is calculated at a step 70. The additive value $P_R$ is obtained by a multiplication between the additive value $I_R$ and a constant $K_4(K_4>1)$. After the calculation of the additive value $P_R(K_4 \cdot I_R)$, the correction value $I_{OUT}$ which is previously calculated by the execution of operations of the A/F routine is read out from the memory location $a_1$ in the RAM 31. Subsequently, the additive value $P_R$ is added to the correction value $I_{OUT}$, and the result is in turn written in the memory location $a_1$ of the RAM 31 as a new correction value $I_{OUT}$, at a step 71. After the calculation of the correction value $I_{OUT}$ at the step 68 or the step 71, a value "0" is set for the flag $F_{AF}$, at a step 72, for indicating that the air/fuel ratio is rich. After the calculation of the correction value $I_{OUT}$ at the step 61, 64, 68 or 71 in this way, the correction value $I_{OUT}$ and the base value $D_{BASE}$ set at the step 51 are added together, and the result of this addition is made as the output value $T_{OUT}$ at a step 73. After the calculation of the output value $T_{OUT}$, the output value $T_{OUT}$ is output to the drive circuit 28 at a step 74. Subsequently, a $K_{ref}$ calculation subroutine is executed at a step 75.

Additionally, after the reset of the time counter A and the start of the counting from the initial value at the step 57, if it is detected that the predetermined time period $\Delta t_1$ has not yet passed, at the step 56, the operation of the step 73 is immediately executed. In this case, the correction value $I_{OUT}$ calculated by the A/F routine up to the previous cycle is read out.

Figure 4:
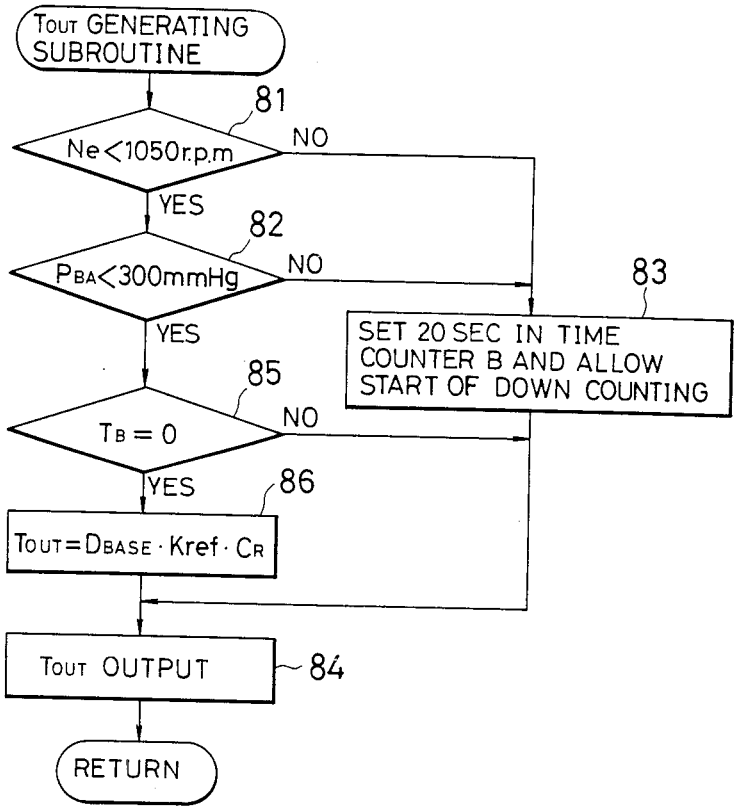
FIGS. 4 and 5 are diagrams showing an $I_{OUT}$ generating subroutine and $K_{ref}$ calculation subroutine, respectively.

Then, in a $T_{OUT}$ generating subroutine shown in FIG. 4, whether or not the engine rotational speed $N_e$ is lower than 1050 rpm and whether or not the absolute pressure $P_{BA}$ in the intake manifold is smaller than 300 mmHg are respectively detected at steps 81 and 82. If $N_e \geqq 1050$ rpm, or $P_{BA} \geqq 300$ mmHg, it is determined that the engine operation is not under the light load condition. In this state, a step 83 sets a time period of 20 seconds in a time counter B incorporated in the CPU 29, so that the down counting is started. Then the output value $T_{OUT}$ calculated at the step 73 is supplied to the drive circuit 28 at a step 84. If $N_e<1050$ rpm and $P_{BA}<300$ mmHg, it is determined that the engine is operating under the light load condition. Then whether or not the count value of the time counter B has reached 0 is detected at a step 85. If $T_B \neq 0$, the output value $T_{OUT}$ calculated at the step 73 is supplied to the drive circuit 28 by the execution of the operation of the step 84. If $T_B=0$, it means that a time period more than 20 seconds has lapsed after the start of the engine operation under the light load, and the output value $T_{OUT}$ is calculated by using an equation: $T_{OUT}=D_{BASE} \cdot K_{ref} \cdot C_R$, at a step 86. In this equation, $K_{ref}$ is a correction value for compensating for an error of the base value $D_{BASE}$ set at the step 51 because of such reasons as the deterioration of the oxygen concentration sensor and the deviation of the base air/fuel ratio of the carburetor, and $C_R$ is a coefficient for correcting the output value $T_{OUT}$ for obtaining an air/fuel ratio around the value of 14.5 when the output value $T_{OUT}$ has a value corresponding to the stoichiometric air/fuel ratio (14.7). After the calculation of the output value $T_{OUT}$ in this way, the calculated output value $T_{OUT}$ is supplied to the drive circuit 28 at the step 84.

Figure 7:
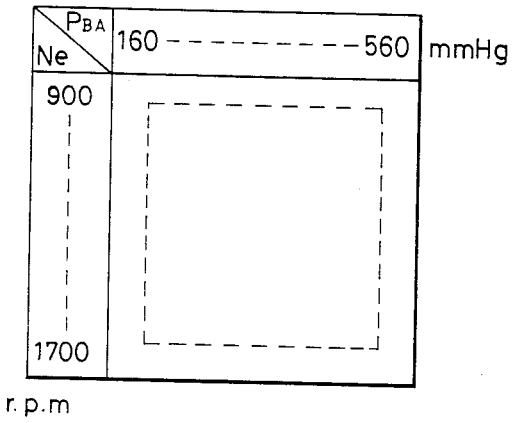
FIG. 7 is a diagram showing a $K_{ref}$ data map stored in a RAM 31 of the control circuit.

In the RAM 31, as shown in FIG. 7, various values of the correction value $K_{ref}$ which are determined by the absolute pressure $P_{BA}$ in the intake manifold and the engine rotational speed $N_e$, are previously stored in the form of a $K_{ref}$ data map. Therefore, the CPU 29 searches a value of the correction value $K_{ref}$ from the $K_{ref}$ data map using present values of the absolute pressure $P_{BA}$ and the engine rotational speed $N_e$, for the calculation of the output value $T_{OUT}$. The RAM 31 is of the non-volatile type, and the memorized contents are maintained even when the engine 5 is stopped. The values of the $K_{ref}$ data map are initialized to 1 before the first use of this system.

The drive circuit 28 is operative to detect the current flowing through the solenoid 9a of the solenoid valve 9 by means of the resistor for detecting the current, and to compare the detected magnitude of the current with the output value $T_{OUT}$. In response to a result of the comparison, the drive transistor is on-off controlled to supply the drive current of the solenoid 9a. In this way, the current flowing through the solenoid 9a becomes equal to a value represented by the output value $T_{OUT}$. Therefore, the air intake side secondary air whose amount is proportional to the magnitude of the current flowing through the solenoid 9a of the solenoid valve 9 is supplied into the intake manifold 4.

Figure 5:
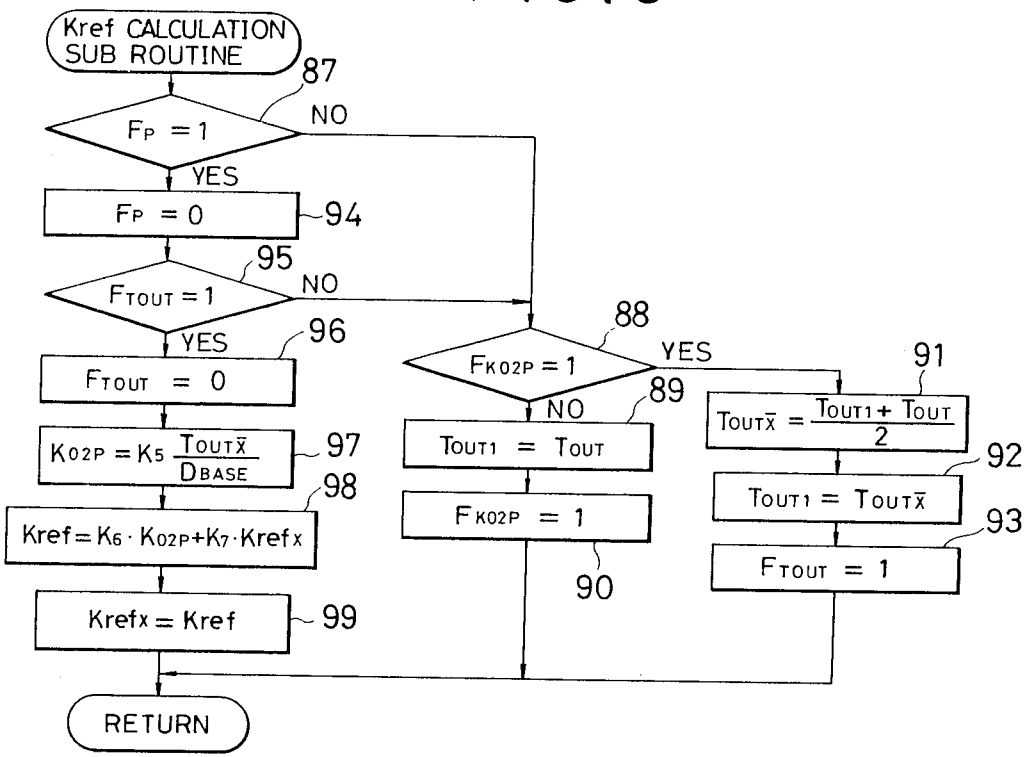

As shown in FIG. 5, in a $K_{ref}$ calculation subroutine, whether or not the flag $F_P$ is equal to 1 is detected at a step 87. If $F_P=0$, whether or not a flag $F_{K02P}$ is equal to "1" is detected at a step 88. The flag $F_{KO2P}$ is provided for indicating that the operation of the step 88 is executed for the first time in this subroutine, and it is initially set to "0" upon application of the power current If $F_{K02P}=0$, the output value $T_{OUT}$ calculated by the maintained as a preceding average value $T_{OUT1}$, at a step 89. At the same time, a value "1" is set for the flag $F_{K02P}$ at a step 90. If $F_{K02P}=1$, it means that the operation of the step 90 has been executed, and the output value $T_{OUT}$ calculated by the A/F routine of the present time and the preceding average value $T_{OUT1}$ are added together, and then divided by 2 so as to produce an average value $T_{OUT\bar{X}}$ of the L output value $T_{OUT}$ at a step 91. The average value $T_{OUT\bar{X}}$ is maintained as the preceding average value $T_{OUT1}$ at a step 92. At the same time, a value "1" is set for a flag $F_{TOUT}$ which indicates that the average value $T_{OUT\bar{X}}$ of the output value $T_{OUT}$ is calculated, at a step 93.

On the other hand, if it is detected that $F_P=1$ at the step 87, it means that the direction of the air/fuel ratio control has changed, and "0" is set for the flag $F_P$ at a step 94. At the same time, whether or not the flag $F_{TOUT}$ is equal to "1" is detected at a step 95. If $F_{TOUT}=0$, it means that the average value $T_{OUT\bar{X}}$ is not yet calculated, and the operation of the step 88 is executed. If $F_{TOUT}=1$, it means that the average value $T_{OUT\bar{X}}$ is already calculated by the operation of the step 91, "0" is set for the flag $F_{TOUT}$ at a step 96. At the same time, by using an equation $K_{O2P}=K_5 \cdot T_{OUT\bar{X}}/D_{BASE}$, a value $K_{O2P}$ indicative of the error of the base value $D_{BASE}$ is calculated at a step 97. In this equation, $K_5$ is a constant. Then, by using an equation $K_{ref}=K_6 \cdot K_{O2P}+K_7 \cdot K_{refx}$, a correction value $K_{ref}$ for correcting the error of the base value $D_{BASE}$ is calculated, and stored in a position in the $K_{ref}$ data map of the RAM 31, corresponding to the present values of the absolute pressure $P_{BA}$ in the intake manifold and the engine speed $N_e$, at a step 98. In this equation, $K_6$ and $K_7$ are constants, and $K_{refx}$ is a correction value obtained by the execution of the operation of the step 98 in the previous cycle. After the calculation of the correction value Kref, the calculated correction value $K_{ref}$ is set as the preceding correction value $K_{refx}$ a step 99. By repeating the operations of this subroutine, the correction value $K_{ref}$ in the $K_{ref}$ is altered to a new value in response to the time-induced change or the deterioration of the sensors.

In the above explained embodiment, the flags $F_P$ and $F_{TOUT}$ are initialized to "0" upon application of the power current. When it is detected that $F_P=0$ step 87, i.e. at the time of execution of this subroutine subsequent to the operation of the step 94 after the change in the direction of the air/fuel ratio control, or when it is detected that $F_{TOUT}=0$ at the step 95, i.e. the execution of this subroutine subsequent to the operation of the step 95 after the calculation of the average value $T_{OUT\bar{X}}$, the operation of the step 88 will be executed The present invention has been described above by way of the example in which the air/fuel ratio control is performed by adjusting the amount of the air intake side secondary air. However, it is to be noted that the present invention is applicable to the control of fuel injection time in an air/fuel ratio control system for an internal combustion engine of the fuel injection type in which a fuel injector or injectors are utilized.

Thus, in the control method of an air/fuel ratio control system according to the present invention, the value of the air/fuel ratio control parameter is determined irrespectively of the output signal of the oxygen concentration sensor, to include a component which varies with time so that the air/fuel ratio is controlled at a value near a target value which is determined in consideration of errors due to reasons such as the deterioration of the oxygen concentration sensor and the deviation of the base air/fuel ratio of the carburetor, when it is detested that the operation of the engine under a light load condition has continued for more than a predetermined time period. This is because the oxygen concentration sensor may become inactive when the engine operation under the light load condition has continued for more than the predetermined time period. In this way, enrichment of the air/fuel ratio is prevented even when the engine operation under the light load condition has continued for more than the predetermined time period, so that the increase of unburned contents in the exhaust gas is prevented.

What is claimed is:

1. A control method for controlling an air/fuel ratio control system in an internal combustion engine comprising the steps of:

setting a base air/fuel ratio control value in accordance with parameters of the engine operation relating to the load on the engine;

setting an operational air/fuel ratio control value corresponding to a target air/fuel ratio by correcting a set value of said base value in response to an output signal of an oxygen concentration sensor disposed in an exhaust gas passage of said internal combustion engine;

controlling the air/fuel ratio of the mixture to be supplied to said internal combustion engine according to said operational air/fuel ratio control value;

setting a correction value indicative of an error caused by the lapse of time due to deterioration of said oxygen concentration sensor or the carburetor of said internal combustion engine;

detecting continuation of a light load operation of said internal combustion engine for more than a predetermined time period; and selecting, as the air/fuel ratio control value, an open loop control value by which said air/fuel ratio of the mixture can be controlled around said target air/fuel ratio in accordance with said set base value and said set correction value irrespectively of said output signal of said oxygen concentration sensor during a time period in which said light load operation continues after the continuation of said light load operation detected by said detecting step.

2. A control method as calimed in claim 1, wherein said oxygen concentration sensor has an output signal characteristic which is degraded as the temperature of said oxygen concentration sensor lowers.

3. A control method as set forth in claim 1, wherein said open loop control value varies gradually in accordance with the lapse of time.

4. A control method as set forth in claim 3, wherein said step of selecting said open loop control value comprises calculating a coefficient indicative of said error generating a correctin value of said base value which is function of said coefficient indicative of said error, and generating said open loop control value in proportion to a multiplication of said base value and said correction value.

* * * * *